US007347288B2

(12) United States Patent
Lee

(10) Patent No.: US 7,347,288 B2
(45) Date of Patent: Mar. 25, 2008

(54) BALL OPERATED BY-PASS TOOL FOR USE IN DRILLSTRING

(76) Inventor: Paul Bernard Lee, 15 Blueridge Place, Calgary (CA) T3L 2N8

( * ) Notice: Subject to any disclaimer, the term of this patent is extended or adjusted under 35 U.S.C. 154(b) by 169 days.

(21) Appl. No.: 10/526,892

(22) PCT Filed: Sep. 1, 2003

(86) PCT No.: PCT/GB03/03786

§ 371 (c)(1),
(2), (4) Date: Nov. 29, 2005

(87) PCT Pub. No.: WO2004/022907

PCT Pub. Date: Mar. 18, 2004

(65) Prior Publication Data

US 2006/0113115 A1 Jun. 1, 2006

(30) Foreign Application Priority Data

Sep. 3, 2002 (GB) ..... 0220447.7

(51) Int. Cl.
*E21B 34/14* (2006.01)

(52) U.S. Cl. ..... 175/317; 166/154; 166/332.4

(58) Field of Classification Search ..... 166/154, 166/155, 318, 332.4, 334.4; 175/317
See application file for complete search history.

(56) References Cited

U.S. PATENT DOCUMENTS 5,499,687 A 3/1996 Lee
6,253,861 B1 7/2001 Carmichael et al.

FOREIGN PATENT DOCUMENTS

WO WO 01/90529 11/2001
WO WO 02/061236 8/2002

*Primary Examiner*—William P Neuder
(74) *Attorney, Agent, or Firm*—Kirton & McConkie; Evan R. Witt

(57) ABSTRACT

A by-pass tool for incorporation in a drillstring is adjustable between an inactive mode in which it allows fluid flow lengthwise of the drillstring during normal drilling operation, and an active by-pass mode when drilling is to be interrupted. The tool includes an outer casing, an axially displaceable sleeve within the casing, a valve seat associated with the sleeve and arranged to receive an activating ball, and by-pass port means in the casing. The valve seat receives the activating ball when the ball is launched from the surface and down the drillstring. The valve seat displaces the sleeve axially to adjust the tool from the inactive mode to the active by-pass mode. The by-pass port means allows a locking ball to partially block the port means and thereby initiate flushing-out of any drillstring fluid debris above the valve seat via the port means.

6 Claims, 2 Drawing Sheets

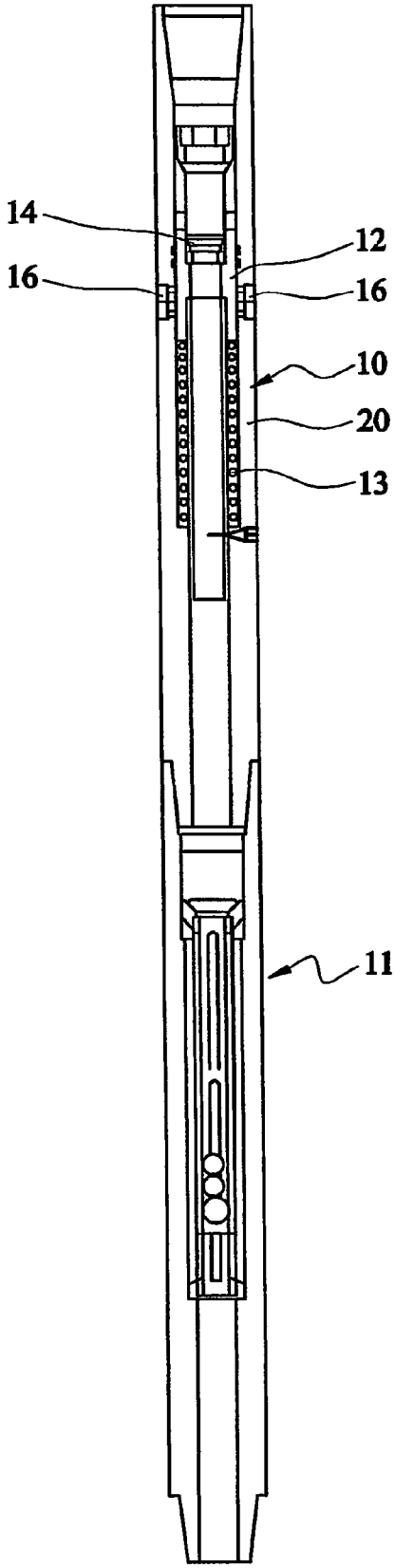
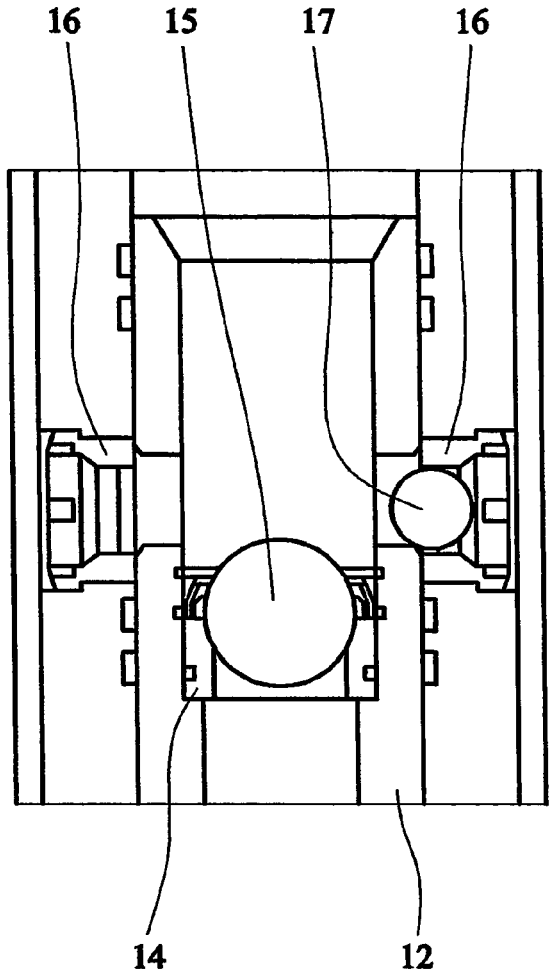
FIG. 2
FIG. 1

BALL OPERATED BY-PASS TOOL FOR USE IN DRILLSTRING

This invention relates to a ball operated by-pass tool for use in a drillstring.

During drilling for underground fluids e.g. water, oil and gas, it is usual to employ a drillstring which has a rotatable drill bit at its lower end to drill through rock formations, and for extra lengths of drill pipe to be added at the surface as drilling proceeds.

During drilling operations, it is usually necessary to interrupt operations from time to time, in order to deal with hole drilling problems as they arise, and the present invention has been developed primarily with a view to providing an improved tool for "tripping" the operation of a drillstring when required.

The invention relies upon use of surface launched tool-activating balls which travel down the drillstring and which make contact with the tool (which is incorporated within the drillstring) so as to initiate by-pass action and allow for tripping the operation of the drillstring.

Examples of use of surface-launched tool activating balls are disclosed in more detail in U.S. Pat. Nos. 4,889,199 and 5,499,687, and to which reference is directed for a fuller disclosure of the construction and operation of the tools and their activation in a by-pass mode; and subsequent reversion to inactive mode of allowing continued flow of fluids lengthwise of the drillstring.

According to the invention there is provided a by-pass tool for incorporation in a drillstring, and which is adjustable between an inactive mode in which it allows fluid flow lengthwise of the drillstring during normal drilling operations, and an active by-pass mode when drilling is to be interrupted, said tool comprising:

an outer casing;

a sleeve displaceable axially within the casing;

a valve seat associated with the sleeve and arranged to receive an activation ball, when the latter is launched from the surface and down the drillstring, said valve seat being operative to displace the sleeve axially and thereby initiate adjustment of the tool from the inactive mode to the active by-pass mode; and, by-pass port means in the casing and arranged to be closed by the sleeve when the tool is in its inactive mode and to be opened to communication with the interior of the drillstring when the tool is in its active mode, said by-pass port means being arranged above the valve seat so as to allow a locking ball (when launched from the surface after the valve seat has received the activating ball) to partially block the port means and thereby initiate flushing-out of any drillstring debris above the valve seat via the port means.

Preferably, the by-pass port means comprises two by-pass ports, a first of which is closeable following launch of the locking ball, whereby drillstring debris can be flushed out via a second of the by-pass ports.

The second by-pass port may be closeable, following launching of a second locking ball, in order to:

(a) close the by-pass port means;

(b) to initiate deformation of the activating ball by upstream drillstring fluid pressure so that the ball is movable downwardly through the valve seat;

(c) the sleeve is returnable to a position corresponding to the inactive mode of the tool; and, (d) the two locking balls are then displaceable out of closing positions over the respective first and second by-pass ports so as to follow the downward movement of the activating ball through the valve seat, thereby to re-set the tool.

Preferably, a by-pass tool according to the invention is provided in combination with a deformable activating ball, and at least one locking ball.

A by-pass tool according to the invention therefore allows for safer and more timely tripping of a drillstring. By locking the port in the open condition of the tool, the drillstring can easily drain and fill during tripping operations.

The by-pass system provided by the tool of the invention may allow operators the ability to open and close the tool "down hole", and typically up to six times in order to deal with hole conditions. The new system can be safe, reliable and effective.

Preferably, in order to reset the tool, it is arranged so as to be capable of reacting to the launching of a second hard ball e.g. a steel deactivation ball, which closes the port or ports, and allows drilling to resume.

A preferred embodiment of by-pass tool according to the invention will now be described in detail, by way of example only, with reference to the accompanying drawing, in which:

FIG. 1 is a side view illustrating the incorporation of a by-pass tool according to the invention in a drillstring, and in its inactive mode, allowing throughflow of fluids lengthwise of the drillstring;

FIG. 2 is a detail view, to an enlarged scale, showing the self-adjustment of a valve seat of the tool, when it receives an activation ball launched from the surface, so as to adjust the tool to its active by-pass mode; and, FIG. 3 shows, through stages 1, 2, 3 and 4, successive phases of operation of the tool, when it adjusts itself between its inactive and active modes.

Figure 3:
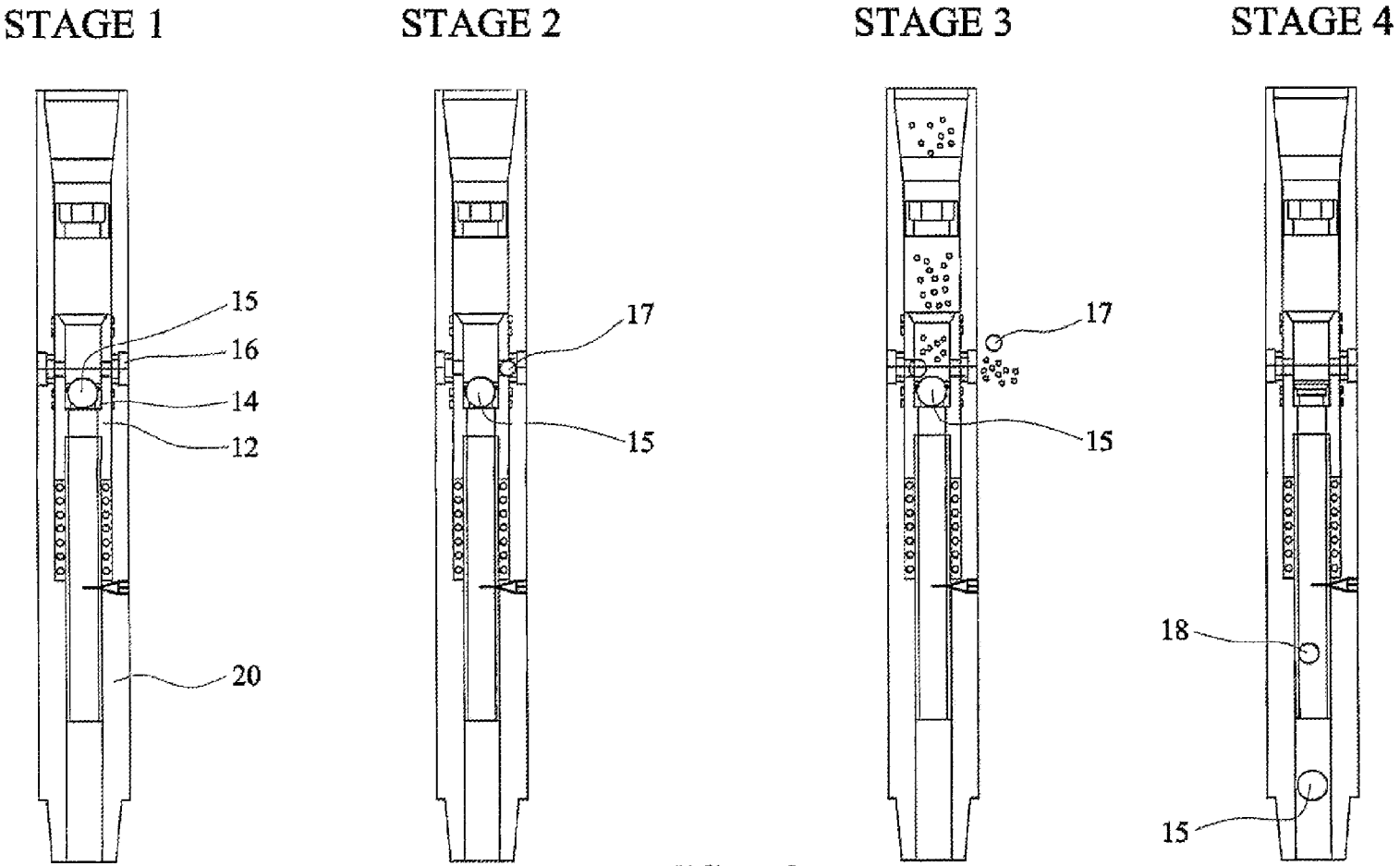

Referring now to the drawings, a by-pass tool according to the invention is designated generally by reference 10 and is intended to be incorporated in a drillstring 11, the tool having an inactive mode, as shown in FIG. 1, in which it allows fluid flow lengthwise of the drillstring during normal drilling operations. However, the tool 10 can be activated to an active by-pass mode when drilling is to be interrupted, so that tripping operations can take place.

The tool comprises a casing 20 which houses an axially displaceable sleeve 12, biased by compression spring 13 to an inactive mode, but which is capable of being displaced against the action of the spring 13 when an activation ball is launched from the surface.

A valve seat 14 associated with the sleeve 12 is arranged on or within the sleeve 12 and can receive a large (deformable) activation ball 15 (see FIG. 2), when the latter is launched from the surface and down the drillstring in order to activate the tool to the active mode. The valve seat 14 is movable downwardly when engaged by the ball 15 (acting under the pressure of the supply of drillstring fluids), and then applies downward movement to the sleeve 12 and thereby exposes or opens by-pass port means in the form of two by-pass ports 16.

The by-pass ports 16 are therefore closed by the sleeve 12, when the tool 10 is in its inactive mode of FIG. 1, and are opened and exposed to the interior of the drillstring when the tool is in its active mode.

The subsequent launching of a locking ball 17 from the surface enters one of the by-pass ports 16, and thereby initiates flushing-out via the other port of any drillstring debris above the valve seat 14. Thus, with the activation ball 15 dropped, and the tool held open, the locking ball 17 moves through the respective one of the ports 16 in the sleeve 12 and lodges in the nozzle provided on the main body. The ball will then land in the nozzle, so that when pressure/flow is reduced, the sleeve 12 will move upwardly, pushing the ball 17 against the nozzle and holding the sleeve open. The activation ball 15 remains on the valve seat, so that no debris can be accumulated above it, and all such debris is simply flushed out of the other port (see FIG. 1).

The following applications may be carried out, utilising the by-pass system disclosed herein:

(a) pump LCM;

(b) increase flow rates;

(c) pump acid;

(d) jet riser, Bops.

Advantages to the use of the system are:

(a) fill pipe;

(b) drain pipe;

(c) equalise or reverse circulate for controlling fluid density;

(d) "shocking" the pipe to remove scale or debris in the drillstring.

Thus, by locking the tool open and dropping one locking ball 17 which closes a first one of the by-pass ports 16, the system will pressure up and apply shear load to the locking ball 17, thereby "shocking" the pipe, so that all debris will exit out of the second port 16. Then a second (hard) locking ball 18 can be dropped, in order to reset the tool and resume drilling. This is achieved by the second ball 18 closing-off the other port 16, and with the activating ball 15 still on the valve seat 14 and the first locking ball 17 closing the first by-pass port 16, increasing drillstring fluid pressure will force the (deformable) activating ball 15 downwardly through the seat 14 and eject the first locking ball 17 (Fig 3, Stage 3), followed by upward movement of the sleeve 12 back to the inactive mode of the tool. The second (hard) locking ball 18 then falls downwardly through the valve seat 14, following the activating ball 15, and thereby re-setting the tool.

The design of the tool therefore is such as to be ball activated and provide a simple system which allows the tool to be opened and closed "down hole" from the surface.

FIG. 3 shows successive stages 1, 2, 3 and 4, involving launching of activation ball 15, and first and second locking or deactivating balls 17, 18. In particular, stage 4 shows how (deformable) activation ball 15 can be forced downwardly through the valve seat 14, and downwardly through the drillstring, followed by the deactivation ball, second (hard) locking ball 18.

The invention claimed is:

1. A by-pass tool for incorporation in a drillstring, and which is adjustable between an inactive mode in which it allows fluid flow lengthwise of the drillstring during normal drilling operation, and an active by-pass mode when drilling is to be interrupted, said tool comprising:

an outer casing;

a sleeve displaceable axially within the casing;

a valve seat associated with the sleeve and arranged to receive an activating ball, when the latter is launched from the surface and down the drillstring, said valve seat being operative to displace the sleeve axially and thereby initiate adjustment of the tool from the inactive mode to the active by-pass mode; and by-pass port means in the casing and arranged to be closed by the sleeve when the tool is in its inactive mode and to be opened to communicate with the interior of the drillstring when the tool is in its active mode, said by-pass port means being arranged above the valve seat so as to allow a locking ball, when launched from the surface after the valve seat has received the activating ball, to partially block the port means and thereby initiate flushing-out of any drillstring fluid debris above the valve seat via the port means.

2. A by-pass tool according to claim 1, in which the by-pass port means comprises two by-pass ports, a first of which is closeable following launch of the locking ball, whereby drillstring debris can be flushed-out via a second of the by-pass ports.

3. A by-pass tool according to claim 2, in which the second by-pass port is closeable, following launching of a second locking ball, in order to:

(a) close the by-pass port means;

(b) to initiate deformation of the activating ball by upstream drillstring fluid pressure so that the ball passes downwardly through the valve seat;

(c) the sleeve is returnable to a position corresponding to the inactive mode of the tool; and (d) the locking balls are then displaceable out of the respective first and second by-pass ports to re-set the tool.

4. A by-pass tool according to claim 1, in combination with a deformable activating ball and at least one locking ball.

5. A by-pass tool according to claim 2, in combination with a deformable activating ball and at least one locking ball.

6. A by-pass tool according to claim 3, in combination with a deformable activating ball and at least one locking ball.

* * * * *